United States Patent [19]

Kawakami

[11] 4,023,546

[45] May 17, 1977

[54] DISTRIBUTOR FOR AN INTERNAL COMBUSTION ENGINE

[75] Inventor: Kazuhiko Kawakami, Katsuta, Japan

[73] Assignee: Hitachi, Ltd., Japan

[22] Filed: Feb. 3, 1976

[21] Appl. No.: 654,965

[30] Foreign Application Priority Data

Feb. 3, 1975 Japan ..... 50-13436

[52] U.S. Cl. ..... 123/148 DS; 123/148 C

[51] Int. Cl.[2] ..... F02P 1/00

[58] Field of Search ..... 123/146.5 A, 148 C, 123/148 DS

[56] References Cited

UNITED STATES PATENTS

| | | | |
|---|---|---|---|
| 2,756,268 | 7/1956 | Knudson | 123/148 C |

FOREIGN PATENTS OR APPLICATIONS

| | | | |
|---|---|---|---|
| 408,743 | 4/1910 | France | 123/148 C |
| 375,915 | 10/1939 | Italy | 123/148 C |
| 159,317 | 2/1921 | United Kingdom | 123/148 C |

*Primary Examiner*—Douglas Hart

*Attorney, Agent, or Firm*—Craig & Antonelli

[57] ABSTRACT

This invention relates to a distributor wherein at least two high voltage pulses are induced according to the rotation of an engine and wherein the high voltage pulses are respectively distributed to at least two spark plugs disposed for the cylinders of the engine. In order to make the structure of the distributor small, a first central terminal which receives one of the high voltage pulses is disposed along the axial direction of the distributor, a second central terminal which receives the other high voltage pulses is disposed in a direction perpendicular to the distributor axis, and first stationary terminals to which the first high voltage pulse is applied through a first rotor terminal from the first central terminal and second stationary terminals to which the second high voltage pulse is applied through a second rotor terminal from the second central terminal are arranged on concentric circles about the first central terminal.

16 Claims, 4 Drawing Figures

DISTRIBUTOR FOR AN INTERNAL COMBUSTION ENGINE

BACKGROUND OF THE INVENTION

This invention relates to a distributor for an ignition device for an internal combustion engine and, more particularly, to a distributor which is equipped with two sets of distribution mechanisms.

In order to reduce harmful components in the exhaust gas of an internal combustion engine, a variety of improvements have been developed. In a proposal for improving an ignition system, two spark plugs are disposed for each cylinder and are ignited simultaneously or with an appropriate phase difference therebetween.

In this case, two sets of distributors are required. There has been considered a method in which the two distributors are connected through gearing and in which they are operated in synchronism with the rotation of the internal combustion engine. The method involves the disadvantage that the entire distributor assembly becomes large. It is accordingly, desirable to effect two sets of power distributions with a single distributor. In this case, however, due to the very high distribution voltages it has been thought extremely difficult to maintain a high insulation withstand voltage and to reduce the size of the overall distributor structure.

SUMMARY OF THE INVENTION

An object of this invention is to provide a distributor equipped with two sets of distribution mechanisms which can be put into a small size.

This invention consists in that the power feed from a first central terminal is executed in the direction of the axis of rotation of a distributor rotor, while the power feed from a second central terminal is executed in a direction perpendicular to the aforecited axis of rotation.

Owing to such an arrangement, it is possible that a first rotor terminal which distributes a high voltage pulse from the first central terminal to first stationary terminals is provided at an upper part of the distributor rotor and a second rotor terminal which distributes a high voltage pulse from the second central terminal to second stationary terminals is provided on the side of the distributor rotor. In consequence, the distributor rotor can be rendered small in size.

Other objects and advantages of the invention will become more apparent upon reference to the following description and drawings.

DETAILED DESCRIPTION OF THE INVENTION

Figure 1:
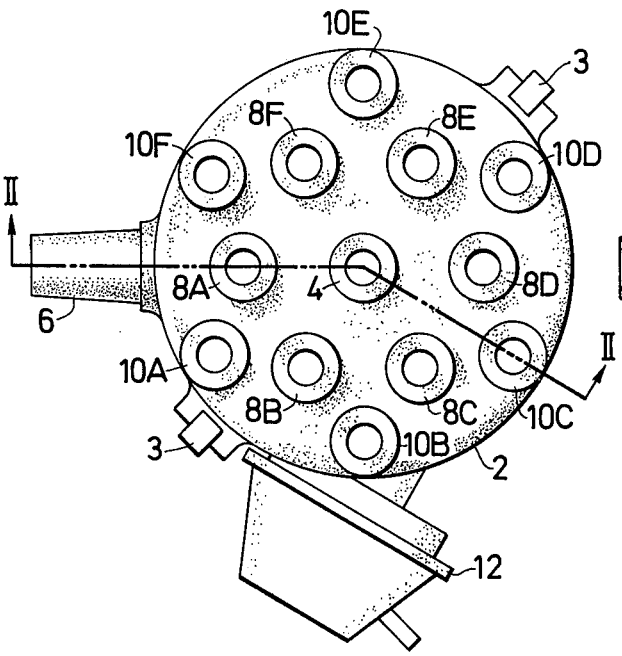
FIG. 1 is a top view of a distributor according to this invention.
Figure 2:
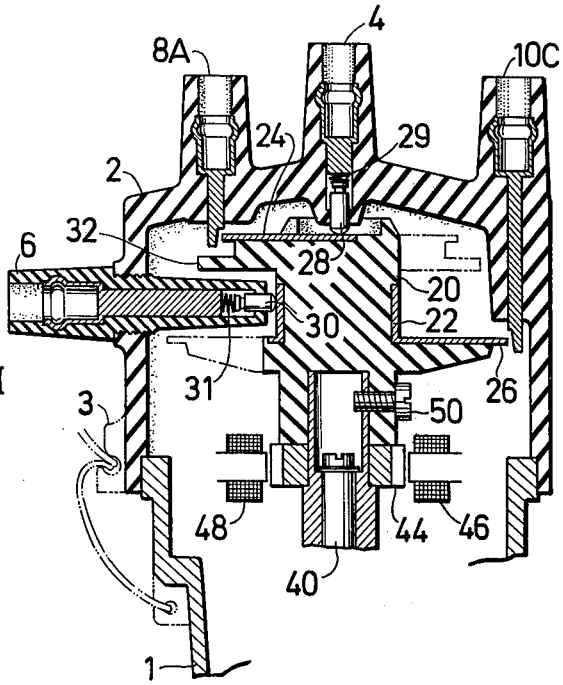
FIG. 2 is a sectional view taken along line A — A in FIG. 1.

FIG. 1 is a top view of a distributor of an embodiment of this invention, while FIG. 2 is a sectional view of the distributor as taken along A — A in FIG. 1. To an upper part of a housing 1, a cap 2 is fixed by a clamp 3. Although the clamp 3 need not appear in the sectional view of FIG. 2, it is depicted by dotted lines in order to aid in understanding the illustration. A first central terminal 4, first stationary terminals 8A — 8F and second stationary terminals 10A — 10F are provided at upper parts of the cap 2, while a second central terminal 6 is provided on the side of the cap 2. Shown at 12 is a vacuum advancer, which controls the ignition timing by the negative pressure of a suction pipe. The first central terminal 4 has a first brush 28, which is pushed downwards by a spring 29.

The second central terminal 6 is provided with a second brush 30, which is pushed rightwards by a spring 31.

A shaft 40 is connected with an internal combustion engine (not shown) by mechanical means, and it is provided with a reluctor wheel 44 for inducing electric signals in a first pickup 46 and a second pickup 48. To an upper part of the shaft, a distributor rotor 20 is secured by a screw 50. At an upper part of the distributor rotor 20, a first rotor terminal 24 is provided at a position at which it comes into contact with the brush 28. Further, the back surface of the terminal 24 is supported by an insulator having a pent roof 32. A slip ring 22 is provided on the side surface of the distributor rotor 20 in a manner to come into contact with the brush 30 of the second terminal 6. The slip ring 22 is electrically connected with a second rotor terminal 26. The second rotor terminal 26 has a back surface supported by an insulator.

In the above construction, a high voltage pulse fed from the first central terminal 4 is transmitted through the first brush 28 to the first rotor terminal 24 and is distributed through an air gap to that one of the first stationary terminals 8A – 8F the size of which is determined in response to the crank angle of the engine, for example, to the first stationary terminal 8A.

Likewise, a high voltage pulse fed from the second central terminal 6 is transmitted through the second brush 30 to the slip ring 22 and further to the second rotor terminal 26. It is distributed from the second rotor terminal 26 through an air gap to that one of the second stationary terminals 10A – 10F the size of which is determined in response to the crank angle of the engine, for example, to the second stationary terminal 10C.

In accordance with the invention, the high voltage pulse from the first central terminal is supplied in the direction of the axis of rotation of the distributor rotor 20, while the high voltage pulse from the second central terminal is supplied in a direction perpendicular to the axis of rotation. Owing to this structure, the distributor rotor 20 itself becomes small-sized, and accordingly, the external shape of the housing 1, as well as that of the cap, 2 becomes small.

Technical results of this invention will be explained as to the concrete example of FIG. 2. The upper surface of the distributor rotor 20 is used for the power feed from the first central terminal, while the cylinder side surface is used for the power feed from the second central terminal. Further, the lower surface of the distributor rotor can be used for the coupling with the shaft 40. The respective surfaces are used very effectively.

Figure 3:
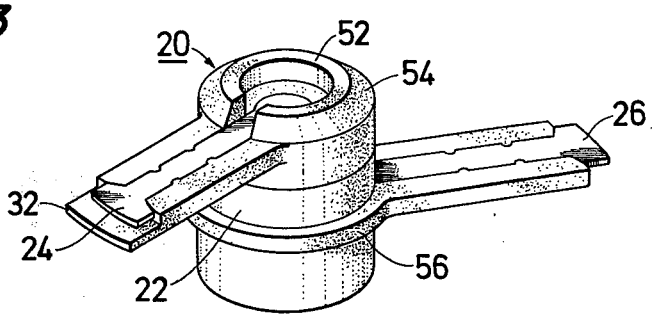
FIG. 3 is a perspective view of a distributor rotor shown in FIG. 2.
Figure 4:
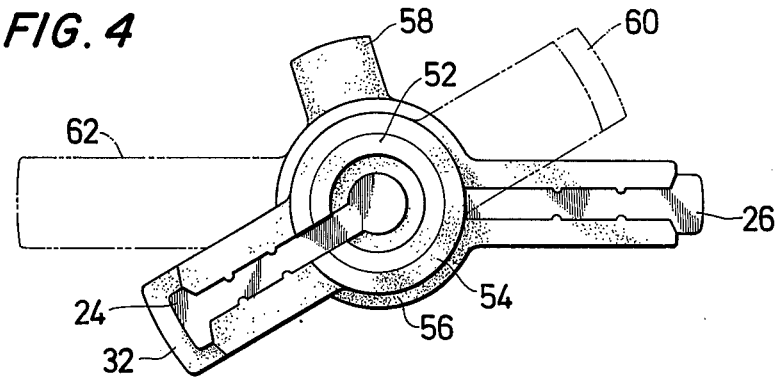
FIG. 4 is a top view of the distributor rotor.

Referring now to FIGS. 3 and 4, more concrete technical results and features will be described in connection with the embodiment of FIGS. 1 and 2. FIG. 3 is a perspective view of the distributor rotor 20, while FIG. 4 is a top view thereof. The distributor rotor 20 has a protrusion 52 which extends in the direction of the axis of rotation. Within the inner hollow of the protrusion 52, the first brush 28 and the first rotor terminal 24 are held in contact. Owing to this structure, the dielectric strength between the slip ring 22 and the first rotor terminal 24 can be increased. That is, structurally, the distance between the first rotor terminal 24 and the slip ring 22 can be made short. Further, the distributor rotor is formed with a slope 54. This facilitates placing the cap 2 onto the housing 1 as the second central terminal 6 is kept fixed to the cap 2. Let it be assumed that the distributor rotor is rotated 180° from the position shown in FIG. 2. At the position after the rotation, the first rotor terminal 24 is situated on the right side (as indicated by a dotted line in FIG. 2), and the second rotor terminal 26 on the left side (as indicated by a dotted line). In the case where the cap 2 is to be inserted onto the housing 1 in such arrangement, the second brush 30 is first kept pushed rightwards to the maximum by the spring 31. The front end of the brush 30 abuts the slope 54. The second brush 30 is being pushed leftwards against the spring 31 and it enters along the slope. The cap 2 can accordingly, be mounted on the housing 3 smoothly.

The first rotor terminal 24 is provided with the pent roof 32. It serves for making long the equivalent high-voltage leakage path between the first rotor terminal 24 and the conductor part as well as the second brush 30 of the second central terminal 6, to thus enhance the dielectric strength.

The distributor rotor having the two sets of rotor terminals has a large overall structure and is heavy. It is, therefore, desirable to fix the distributor rotor to the shaft 40 by the screw 50. In this case, the screw 50 joins with the shaft 40 and, accordingly, is at ground potential. Hence, the dielectric strength between the screw 50 and the slip ring 22 as well as the second rotor terminal 26 creates a problem.

It is, accordingly, desirable to increase the leakage dielectric strength in such a way that the screw 50 is provided below the backside insulator of the second rotor terminal 26 or that a protrusion of an insulator is specially provided above the screw 50. Further, it is greatly effective to provide such a protrusion over the entire circumference, and not only can it render the distance between the screw 50 and the slip ring 22 short, but also shorten the insulator extending in the direction of the shaft. An insulator 56 in FIGS. 3 and 4 is an example thereof. Although the protrusion is not considerably large in these figures, it is of greater effect that the protrusion extends outwardly more.

In the case of rotating the distributor rotor which has the first and second rotor terminals 24 and 26 as in the present embodiment, balancing is necessary because the position of the centroid inevitably becomes high and the weight is heavy. It is accordingly, necessary to dispose balancers in directions opposite to the respective rotor terminals as indicated by dotted lines 60 and 62 in FIG. 4. However, when the balancers are disposed in such a manner, the gravity of the distributor rotor becomes large and also its moment becomes large. It is therefore, desirable to employ a single balancer, as shown at 58. Thus, the moment can be made small, and the inertia force attendant upon the rotation of the distributor rotor can be made small. Also, when the balancer as indicated by the dotted line 60 is provided, the second central terminal touches the balancer 60 to render the insertion of the cap difficult. Accordingly, the balancer should preferably be provided below the slip ring 22.

Since, in the present embodiment, the first central terminal and the first and second stationary terminals are provided in the upper surface of the cap 2 and only the second central terminal is provided in the side surface of the cap, the arrangement on the top of the cap becomes symmetric and is neat. Also, the two sets of stationary terminals 8A – 8F and 10A – 10F can be arranged on concentric circles, and the cutting of those surfaces of the respective stationary terminals which oppose to the distributor rotor is facilitated. Furthermore, all the connections other than that of the second central terminal are in one direction, so that the wirings are not disordered. The flow of material for making the cap 2 is better when the second central terminal 6 is fixed after formation of the cap 2 than when the second central terminal 6 is made by molding integrally with the cap 2. To detachably mount the second central terminal 6 by a screw, a leaf spring or the like renders easier the cutting of those surfaces of the stationary terminals 8A – 8F and 10A – 10F which oppose to the respective rotor terminals. Further, the second central terminal 6 may be inserted and fixed after fixing the cap 2 to the housing 1 by the clamper 3. In the case of detaching the cap 2, to detach the cap 2 as the central terminal 6 is secured thereto is more preferable than to remove the second central terminal 6 and then remove the cap 2 from the housing 1. In this case, if the position of the distributor rotor 20 is as shown by solid lines in FIG. 2, the second central terminal 6 and the first rotor terminal 24 may collide with each other and be damaged. In order to avoid this drawback, it is necessary that the stop position of the distributor rotor 20 be seen from the outside and that the cap 2 is rotated and taken off while the distributor rotor 20 is being observed. It is therefore desirable to make the cap 2 of a transparent material.

I claim:

1. A distributor comprising:

a shaft which rotates according to the rotation of an engine, a distributor rotor which is mounted on one end of said shaft, a housing in which said shaft is provided, a cap which is mounted on said housing and in which said distributor rotor is provided, a first central terminal which is provided at an upper surface of said cap, first stationary terminals which are arranged in said cap along the circumference of a circle surrounding said first central terminal, second stationary terminals which are arranged in said cap concentrically with said first stationary terminals around said first central terminal, a first rotor terminal which is provided at an upper part of said distributor rotor, which is electrically connected with said first central terminal, and which radially extends towards said first stationary terminals, a slip ring which is provided on a side portion of the outer periphery of said distributor rotor, a second rotor terminal which is electrically connected with said slip ring and which extends towards said second stationary terminals, and a second central terminal which is mounted on a side surface of said cap and which is electrically connected with said slip ring of said distributor rotor.

2. The distributor according to claim 1, wherein said distribution rotor contains insulator material and has a protrusion which extends towards said first central terminal along the axis of said distributor rotor at an outer peripheral part of said first rotor terminal provided at the upper surface of said distributor rotor.

3. The distributor according to claim 1, wherein the outer periphery of the upper part of said distributor rotor has a sloped portion.

4. The distributor according to claim 1, wherein said distributor rotor contains insulator material and has a protrusion which extends perpendicularly to the rotor axis between said slip ring electrically connected with said second rotor terminal and a screw provided for fixing said distributor rotor to the rotor shaft.

5. The distributor according to claim 1, further comprising means for mounting said second central terminal on said cap, and wherein said rotor contains insulator material and has a protrusion provided perpendicularly to the axis of said distributor rotor between said first rotor terminal and said slip ring.

6. The distributor according to claim 1, further comprising a balancer which extends in a direction different from the axial directions of said first and second rotor terminals provided at the underside of said distributor rotor.

7. The distributor according to claim 1, wherein said cap is made of a transparent material.

8. The distributor according to claim 2, wherein said distributor rotor contains insulator material and has a protrusion which extends perpendicularly to the rotor axis between said slip ring electrically connected with said second rotor terminal and a screw provided for fixing said distributor rotor to the rotor shaft.

9. The distributor according to claim 8, wherein the outer periphery of the upper part of said distributor rotor has a sloped portion.

10. The distributor according to claim 9, further comprising a balancer which extends in a direction different from the axial directions of said first and second rotor terminals provided at the underside of said distributor rotor.

11. In a distributor having a distributor rotor mounted on a shaft which rotates according to the rotation of an engine, a housing within which said shaft is disposed, and a distributor cap mounted on said housing and containing said distributor rotor therein, said cap having a central terminal provided at an upper surface thereof and a plurality of first stationary terminals arranged in said cap along the circumference of a first circle which surrounds said central terminal, and said rotor having a first rotor terminal electrically connected with said central terminal and extending radially so as to come in electrical contact with each respective one of said first stationary terminals upon the rotation of said rotor, the improvement wherein said distributor cap further includes a plurality of second stationary terminals arranged in said cap along the circumference of a second circle which surrounds said central terminal and is concentric with said first circle, and a side terminal disposed at the side of said cap, and said distributor rotor further includes a second rotor terminal electrically connected with said side terminal and extending radially so as to come in electrical contact with each respective one of said second stationary terminals upon the rotation of said rotor.

12. The improvement according to claim 11, wherein said distributor rotor includes a slip ring electrically connecting said side terminal with said second rotor terminal.

13. The improvement according to claim 12, wherein said distributor rotor contains insulator-material and further includes a first insulating protrusion radially extending perpendicular to the axis of rotation of said rotor and beyond the outer radial edge of said first rotor terminal.

14. The improvement according to claim 13, wherein said distributor further includes a second insulating protrusion radially extending perpendicular to the axis of rotation of said rotor, said second rotor terminal being disposed upon said second insulating protrusion.

15. The improvement according to claim 14, wherein said rotor further includes a third insulating protrusion extending along the axis of rotation of said rotor as surrounding the electrical connection of said first rotor terminal with said central terminal.

16. The improvement according to claim 15, further comprising a balancer which extends in a direction different from the axial directions of said first and second rotor terminals provided at the underside of said distributor rotor.

* * * * *